United States Patent [19]

Strasser

[11] Patent Number: 4,514,020

[45] Date of Patent: Apr. 30, 1985

[54] DESK LOCK SYSTEM

[76] Inventor: Thomas Strasser, 15 Glens Dr. E., Boynton Beach, Fla. 33436

[21] Appl. No.: 502,758

[22] Filed: Jun. 9, 1983

[51] Int. Cl.[3] ..... E05C 7/06

[52] U.S. Cl. ..... 312/220; 292/202; 292/DIG. 9; 312/222

[58] Field of Search ..... 292/202, 300, 304, DIG. 9, 292/DIG. 21; 312/220-222; 70/96-100

[56] References Cited

U.S. PATENT DOCUMENTS

| | | | |
|---|---|---|---|
| 871,727 | 8/1931 | Morrison | 292/DIG. 9 X |
| 1,379,977 | 5/1974 | Hamlin | 312/221 X |
| 1,817,101 | 11/1907 | Roby | 292/DIG. 9 X |
| 3,811,302 | 5/1921 | Sorensen | 70/100 |
| 4,068,875 | 1/1978 | Miller | 292/DIG. 9 X |

*Primary Examiner*—Gary L. Smith
*Assistant Examiner*—Russell W. Illich

[57] ABSTRACT

A lock system for a desk drawer, a cabinet door or the like includes a hinge consisting of a first supporting hinge plate, a second locking hinge plate and a joint rotatably connecting said first and second hinge plates. The hinge, when locked, has a substantially planar configuration and an unlocked configuration in which the second hinge plate is substantially perpendicular to the first hinge plate. The hinge is positioned at the opposed, adjacent interior edges of a first door panel of a cabinet, desk drawer or the like and a second door panel of an adjacent cabinet, desk drawer or the like with the first supporting hinge plate being rigidly attached to the interior surface of the first door panel adjacent to the second door panel. The second locking hinge plate is of sufficient width and thickness so that it protrudes between the first and second door panels, when in the unlocked configuration, providing an external handle by which the door panel to which it is attached may be opened and closed, even when the adjacent drawer or door is locked. When the hinge is in the planar locking configuration, the door panel to which it is rigidly attached can be locked by locking the adjacent door panel, which has an interior surface which presses and abuts against the second locking hinge plate when the adjacent door panel is shut. Thus, when locked, the lock is not visible from the exterior, providing greater security.

12 Claims, 5 Drawing Figures

DESK LOCK SYSTEM

THE FIELD OF THE INVENTION

This invention generally relates to novel locks and lock mechanisms, particularly to lock systems for desk drawers, doors of cabinets and the like which have an easy, rapid operation and improved security features.

BACKGROUND OF THE INVENTION

It is not unusual for disk lock mechanisms to incorporate features so that locking a central disk drawer also locks adjacent drawers. However, these mechanisms have several disadvantages. First, it is impossible to tell at a glance whether the desk is, in fact locked even though its drawers are shut. The mechanism may be relatively complicated and expensive. Also, these mechanisms may not allow the side drawers to remain unlocked, while the central door is locked. Of course, drawers of a desk may be provided with individual locks, however, this calls attention to drawers containing especially important material. Furthermore, a plurality of locks may involve a plurality of keys which is inconvenient and can cause confusion. An especially conventional novel lock which overcomes the disadvantages of the prior art mechanisms is described herein.

It is an object of the present invention to provide a lock system for a desk drawer, door of a cabinet or the like which can be conveniently locked or unlocked, when an adjacent compartment drawer, door or the like is locked, but which will be unlocked when the adjacent drawer, door or the like is unlocked.

It is also an object of the present invention to provide a lock system for such a desk drawer or compartment door which is not visible from the exterior when locked, thus providing for improved security by not calling attention to the fact that it is locked.

It is a further object of the present invention to provide such a lock system which is visible exteriorly when unlocked, but invisible when locked, thus providing for improved security and additionally providing an external handle by which the drawer, door or the like may be opened, when it is unlocked.

It is an object of this invention to provide a lock system for a desk drawer, cabinet door or the like which may be unlocked when the drawer adjacent to it is locked.

SUMMARY OF THE INVENTION

The novel lock system of this invention includes a hinge consisting of a first supporting hinge plate, a second locking hinge plate and a joint rotatably connecting the first and second hinge plates. The hinge has a substantially planar, locking configuration and an unlocked configuration in which the second hinge plate is substantially perpendicular to the first hinge plate. The hinge is positioned at the opposed, adjacent interior edges of a first door panel of a cabinet, desk drawer or the like and a co-planar second door panel of an adjacent cabinet, desk drawer or the like. The first supporting hinge plate is rigidly attached to the interior surface of the first door panel adjacent the second door panel. The second locking hinge plate is of sufficient width and thickness so that it protrudes between the first and second door panels, when it is in the unlocked configuration, thus providing an external handle by which the drawer or door, to which it is attached, may be opened and closed. When the hinge is in the planar locking configuration, the door or drawer to which it is rigidly attached can be locked by locking the adjacent drawer or door, which has an interior surface which presses and abuts against the hinge when that adjacent door or drawer is shut. Thus, when locked, the lock for the door panel, to which the hinge is rigidly attached, is not visible from the exterior, providing greater security for the contents of the compartment behind that door panel.

BRIEF DESCRIPTION OF THE DRAWINGS

The present invention will be made more readily apparent by a consideration of the accompanying drawings in which.

DETAILED DESCRIPTION OF THE INVENTION

Figure 1:
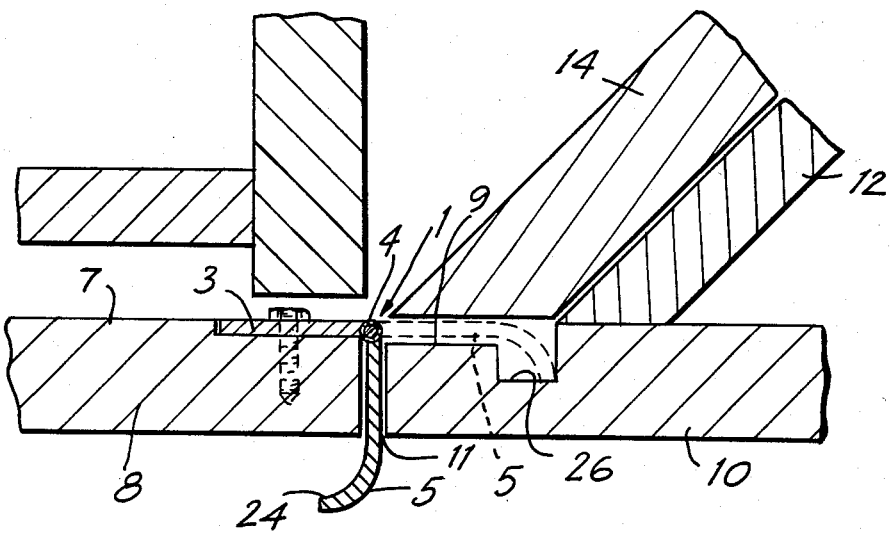
FIG. 1 is a horizontal sectional view of the novel lock system of the preferred embodiment of this invention showing the hinge mounted on a door panel of a typical desk.
Figure 2:
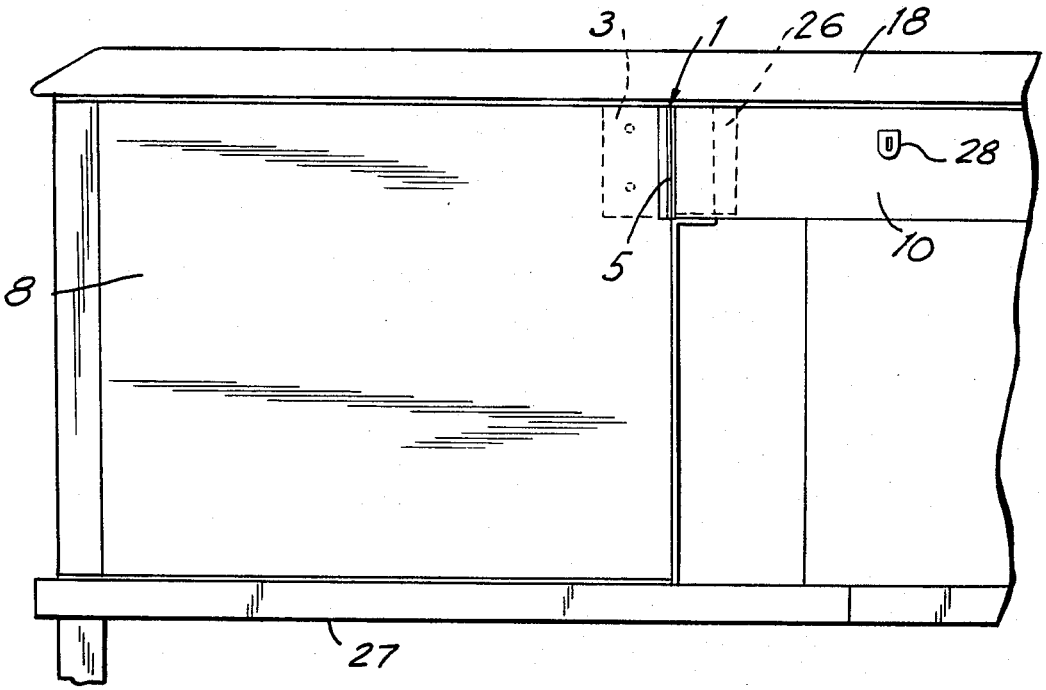
FIG. 2 is a front partial perspective view of a desk showing the novel lock system of FIG. 1 with the hinge in the visible opened configuration.
Figure 3:
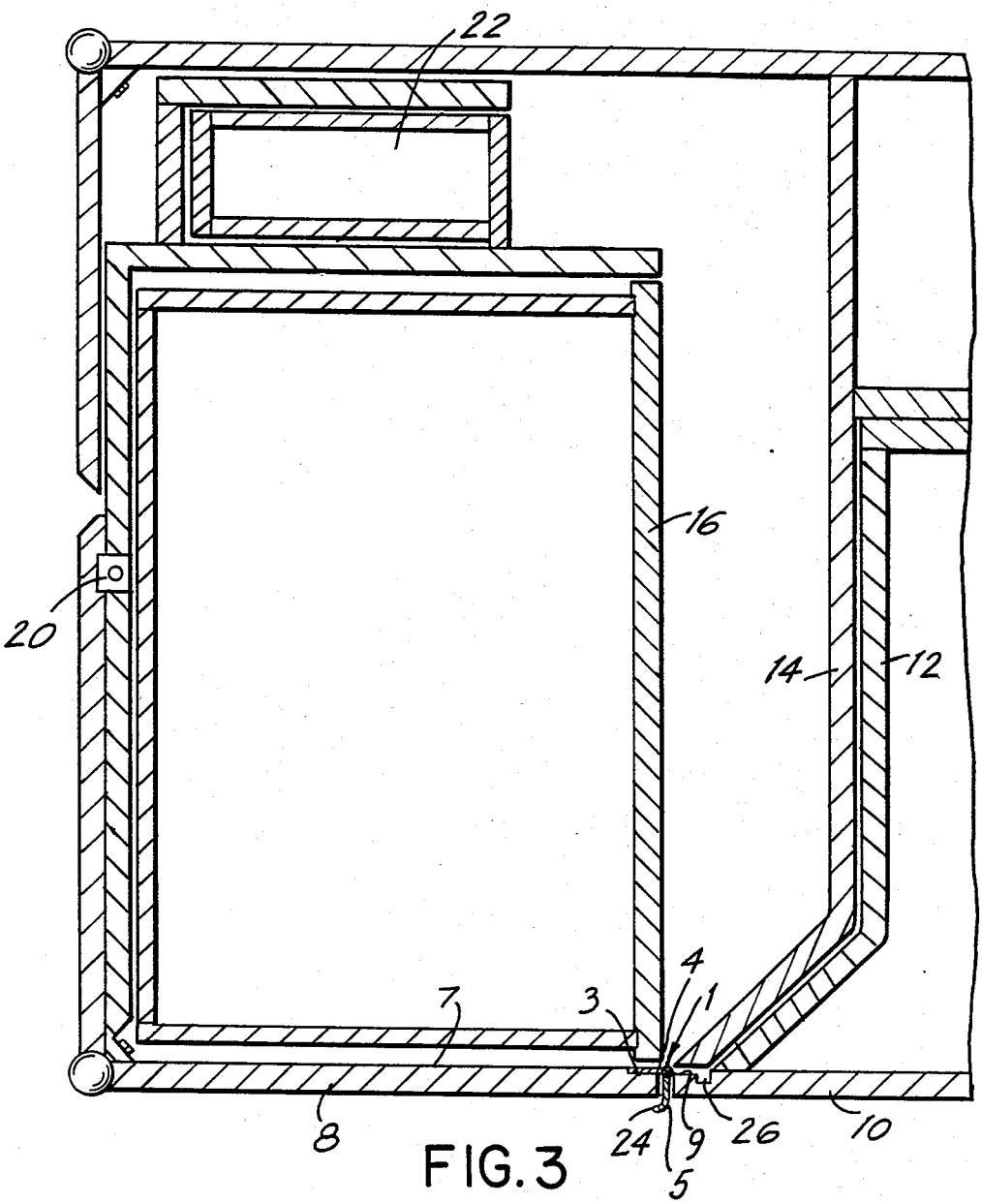
FIG. 3 is a horizontal sectional view of the novel lock system of FIG. 1 showing additional details of the desk in which it is mounted.

The preferred embodiment of the novel lock system of this invention, shown in FIGS. 1–3, comprises a hinge 1 having a first substantially planar supporting hinge plate 3, a joint 4, and a second substantially planar locking hinge plate 5. The supporting hinge plate 3 is rigidly attached to the interior plane surface 7 of a first door panel 8 of cabinet 16 adjacent a central desk drawer 12. The hinge 1 is positioned so that the joint 4 is approximately centered between the edge of interior plane surface 7 of first door panel 8 of cabinet 16 and the adjacent edge of interior plane surface 9 of a second front panel 10, having lock 28, of desk drawer 12.

The hinge 1 has a locking, substantially planar configuration in which the supporting first hinge plate 3 is substantially planar with the locking second hinge plate 5 and an unlocked configuration in which the locking hinge plate 5 is substantially perpendicular to the supporting hinge plate 3, as shown in FIGS. 1 and 2. Hinge 1 can be changed from the locking configuration to the unlocked configuration by rotating locking hinge plate 5 about joint 4. However, joint 4 is constructed, as is common for this type of hinge, so that there is only one locked configuration. As shown in FIG. 1, when locking hinge plate 5 is rotated counter-clockwise from the unlocked to the locking configuration joint 4 has sufficient strength to stop hinge plate 5 from further rotation past the planar configuration, shown in FIG. 5, i.e., it cannot be rotated further in the counterclock-wise direction.

When hinge 1 is in the locking configuration, hinge plate 5 presses and abuts on interior surface 9 of second front panel 10 when drawer 12 is shut and locked, thus locking the door panel 8 to the cabinet 16, which cabinet 16 is inside the desk. Hinge plate 5 is of sufficient width and thickness so that when hinge 1 is in the unlocked configuration, hinge plate 5 protrudes between the first door panel 8 and second panel 10 to provide a visible external handle by which the door panel 8 may be opened and closed.

In the preferred embodiment, supporting hinge plate 3 and locking plate 5 are substantially rectangular and exterior handle 24 is formed by turning the vertical edge of locking hinge plate 5 parallel to, but not connected to, joint 4 exteriorly to form a lip. Furthermore, the inner surface 9 of the second front panel 10 of drawer 12 is provided with a rectangular recess 26 positioned and conformed so as to receive exterior handle 24 when drawer 12 is closed covering exterior handle 24 from view from the exterior of drawer 12.

Additional structural details of the preferred embodiment and work desk are provided in FIGS. 2–3. The novel lock system of the preferred embodiment is shown as a lock for a cabinet 16 which in the work desk contains a rotating file which rotates about pivot 20 and has additional interior drawers 22 therein. Support wall 14 provides a stop and partial support for drawer 12. The interior surface 9 is substantially coplanar with interior surface 7, when motion of drawer 12 inwardly is stopped abutting against support wall 14. The desk is also provided with a top piece 18, a bottom piece 27 and other structural details. These additional structural details are, however, not material to the practice of the invention.

Figure 4:
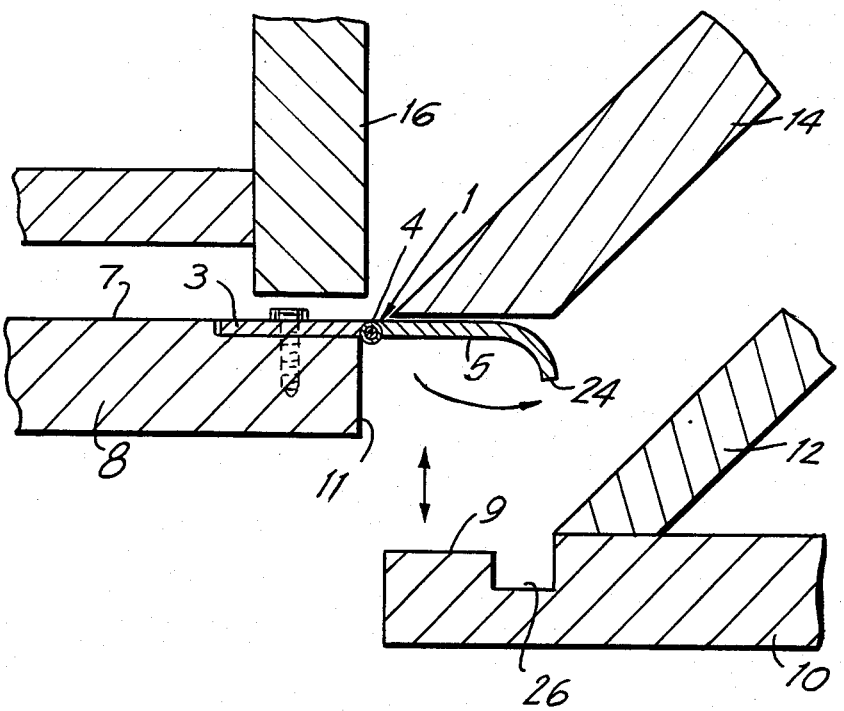
FIG. 4 is a horizontal, sectional view of the lock system of FIG. 1 showing how the hinge is placed in its locked position when the adjacent drawer is opened.
Figure 5:
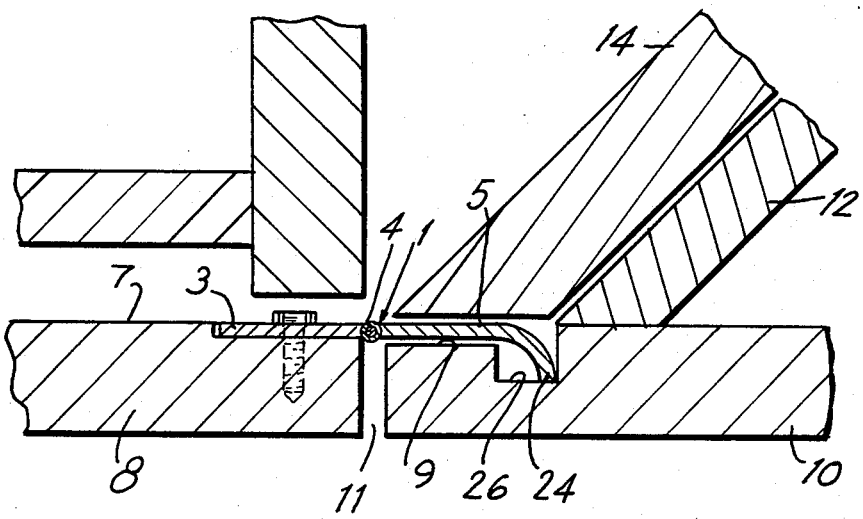
FIG. 5 is a horizontal, sectional view of the lock system of FIG. 1 in the locked configuration in which the lock system can not be seen from outside the desk.

The operation of the lock system of this invention is shown in FIGS. 1, 4 and 5. In FIG. 1, first door panel 8 of cabinet 16 is shown in the shut position, while second locking hinge plate 5 is protruding through the gap 11 between second front panel 10 of central drawer 12 and the first door panel 8 of cabinet 16. Thus, cabinet 16 is shown unlocked in this figure. First door panel 8 may be opened or closed by pulling or pushing exterior handle 24, while central drawer 12 remains locked. When it is desired to lock cabinet 16, central drawer 12 is opened as shown in FIG. 4 and the lock system is moved from the unlocked configuration of FIG. 1 to the locked configuration by rotating second locking hinge plate 5 about joint 4. Then as shown in FIG. 5, central drawer 10 is shut and locked, pressing interior surface 9 of second front panel 10 against locking hinge plate 5, preventing opening of first door panel 8 of cabinet 16. Furthermore, the novel lock system is not visible from the exterior, when locked, giving no indication of the existence of the interior of cabinet 16.

What is claimed is:

1. A lock system for a desk including:

adjacent first and second door panels each having; an interior face and open and closed positions;

locking means to selectively lock said second panel in its closed position;

hinge means to selectively lock said first panel in its closed position when said second panel is locked, said hinge means comprising a first hinge plate attached to the first panel at the interior face of said first panel, a second hinge plate which protrudes from between said first and second panel when they are closed and unlocked, and which abuts the interior face of the second panel when they are closed and locked; and a joint means pivotally connecting said first and second hinge plates and having a limited angle of rotation; wherein the interior faces of said first and second panel doors are co-planar when they are in their closed and locked positions.

2. A lock system as in claim 1 wherein said first and second hinge plates are planar and they are co-planar when the first and second panel doors are in their closed and locked positions.

3. A lock system as in claim 2 wherein said hinge plates are perpendicular when the first panel door is in its closed and unlocked position.

4. A lock system as in claim 3 wherein the joint means permits rotation of the hinge plates in one direction from their perpendicular to their co-planar position and not beyond their co-planar position in that direction.

5. A lock system for a desk including:

adjacent first and second door panels each having an interior face and open and closed positions;

locking means to selectively lock said second panel in its closed position;

hinge means to selectively lock said first panel in its closed position when said second panel is locked, said hinge means comprising a first hinge plate attached to the first panel at the interior face of said first panel, a second hinge plate which protrudes from between said first and second panel when they are closed and unlocked, and which abuts the interior face of the second panel when they are closed and locked; and a joint means pivotally connecting said first and second hinge plates and having a limited angle of rotation; wherein said second hinge plate has a handle portion which protrudes beyond said first and second panel doors when the said panel doors are in their closed and unlocked positions.

6. A lock system including a first door panel of a drawer, a second door panel which is a panel of a drawer, said first and second door panels being adjacent and having substantially co-planar respective first and second interior surfaces when in their closed positions; said lock system further comprising a hinge having a first substantially planar supporting hinge plate, a second substantially planar locking hinge plate, and a joint means to rotatably connect said first supporting hinge plate to said second locking hinge plate, said joint means permitting rotation of said hinge plates from an unlocked position in which said second locking hinge plate is substantially perpendicular to said first supporting hinge plate to a locked position in which said second locking hinge plate is substantially co-planar with said first supporting hinge plate and without permitting further rotation past said co-planar position, said first supporting hinge plate being rigidly attached to said first interior surface near its edge and adjacent to said second interior surface; said second locking hinge plate being of such a width and thickness and said joint means having sufficient strength so that, when said lock system is in said locking position, said second locking hinge plate presses on and abuts against said second interior surface when said second door panel is closed and locked but, when said lock system is in said unlocked position, said second locking hinge plate protrudes between said first and second door panels to provide a visible exterior handle, whereby, when said lock system is in said unlocked position and said first door may be opened when said second door panel is locked.

7. A lock system according to claim 6 wherein said second locking hinge plate has a curved handle portion for grasping said second locking hinge plate.

8. A lock system according to claim 7 wherein said handle portion comprises an externally turned lip formed on the edge of said second locking hinge plate.

9. A lock system according to claim 7 wherein said first and second hinge plates are rectangular, and said second interior surface has a recess positioned therein and conformed to receive said handle portion so that said second door panel may be easily and conveniently shut and locked.

10. A lock system according to claim 6 wherein said first panel is a door to a cabinet portion of a desk.

11. A lock system according to claim 6 wherein said second panel is a portion of a desk drawer.

12. A lock system according to claim 7 wherein said second panel has an indentation adjacent said edge to receive said handle portion.

* * * * *